US010292218B1

(12) United States Patent
Lee

(10) Patent No.: US 10,292,218 B1
(45) Date of Patent: May 14, 2019

(54) LIGHT EMITTING DIODE CONTROL CIRCUIT WITH CONTROLLER DC BIAS AND AC POWER LINES LOAD CURRENT MANAGEMENT

(71) Applicant: Sheng-Hann Lee, Saratoga, CA (US)

(72) Inventor: Sheng-Hann Lee, Saratoga, CA (US)

( * ) Notice: Subject to any disclaimer, the term of this patent is extended or adjusted under 35 U.S.C. 154(b) by 0 days.

(21) Appl. No.: 15/869,053

(22) Filed: Jan. 12, 2018

(51) Int. Cl.
*H05B 33/08* (2006.01)

(52) U.S. Cl.
CPC ..... *H05B 33/0818* (2013.01); *H05B 33/0845* (2013.01)

(58) Field of Classification Search
None
See application file for complete search history.

(56) References Cited

U.S. PATENT DOCUMENTS

2010/0109558 A1* 5/2010 Chew ..... H05B 33/0803 315/294
2016/0156275 A1* 6/2016 Ilic ..... H05B 33/0806 315/209 R

* cited by examiner

*Primary Examiner* — Dedei K Hammond
(74) *Attorney, Agent, or Firm* — Winston Hsu

(57) ABSTRACT

A light emitting diode control circuit includes a power transistor, a voltage controller, a first resistor, an inductor, a first diode, a second resistor, a third resistor, and a voltage regulation module. The voltage controller outputs a gate control signal to the control terminal of the power transistor. The first resistor is coupled to the power transistor. The inductor is coupled to the first resistor. The light emitting diodes are coupled to the inductor. The first diode is coupled between a power input terminal and the power transistor. The second resistor is coupled to another power input terminal and the voltage controller. The voltage regulation module is coupled to the voltage controller and the third resistor. The voltage regulation module includes a plurality of light emitting diodes and provides the supply voltage.

21 Claims, 5 Drawing Sheets

LIGHT EMITTING DIODE CONTROL CIRCUIT WITH CONTROLLER DC BIAS AND AC POWER LINES LOAD CURRENT MANAGEMENT

BACKGROUND OF THE INVENTION

1. Field of the Invention

The present invention is related to a light emitting diode control system, especially related to a cost-effective light emitting diode control system with elegant DC bias and AC power lines load current management.

2. Description of the Prior Art

The solid-state light emitting diode (LED) has been widely applied in many fields due to its high efficiency and long lifespan. However, since LED is a semiconductor diode with a P-N junction, it requires an LED control circuit to supply a forward DC voltage for operation.

Among many topologies of the LED control circuit, the high-side switching (HSS) scheme is a popular one. The LED control circuit with a high-side switching scheme usually means that the inductor receives the high voltage through the high-side switch, and the LED control circuit can magnetize and demagnetize the inductor to output the DC supply voltage by controlling the high-side switch.

Regarding the controller DC bias, the DC voltage supplied to the LED can also be applied to the controller of the power MOS with the high-side switching scheme. However, since the voltage required by the controller is usually lower than the voltage required by the LED, a series-connected Zener diode can subtract the LED voltage to a proper level. That is, by selecting a high-voltage Zener diode with the desired breakdown voltage, a lower voltage can be supplied to the controller based on the original DC voltage for the LED.

However, since the LED and the Zener diode have independent voltage tolerances and also exhibit positive and negative voltage temperature coefficient separately, voltage supplied to the controller can easily fall outside of its nominal range and halt operations either due to over voltage protection or under voltage lockout unexpectedly.

On the AC power lines load current, a triode-alternating-current (TRIAC) dimmable LED lamp must always keep the TRIAC in conduction in each AC power line cycle, so a buck-boost converter is commonly utilized because it draws power continually till zero crossing. In parallel, either a damped capacitor or a switchable resistive load is added in across the AC power lines as a bleeder (i.e., dummy load) because the LED lamp is too efficient to present a veritable load to the TRIAC in deep dimming. It is also critical to maintain a proper supply voltage to the voltage controller in deep dimming despite a very short demagnetization time.

SUMMARY OF THE INVENTION

One embodiment of the present invention discloses a light emitting diode control circuit. The light emitting diode control circuit includes a first power input terminal, a second power input terminal, a power transistor, a voltage controller, a first resistor, an inductor, a first diode, a second resistor, a third resistor, a fourth resistor, and a voltage regulation module.

The power transistor has a first terminal coupled to the first power input terminal, a second terminal, and a control terminal. The voltage controller includes a first terminal coupled to the second terminal of the power transistor and configured to sense a current outputted from the power transistor, a second terminal configured to receive a reference voltage, a third terminal configured to receive a supply voltage, a fourth terminal coupled to the control terminal of the power transistor and configured to output agate control signal to the control terminal of the power transistor, and a fifth terminal configured to sense a detection voltage.

The first resistor has a first terminal coupled to the second terminal of the power transistor, and a second terminal configured to receive the reference voltage. The inductor has a first terminal coupled to the second terminal of the first resistor, and a second terminal. The first diode has an anode coupled to the second power input terminal, and a cathode coupled to the second terminal of the power transistor. The second resistor has a first terminal coupled to the first power input terminal, and a second terminal coupled to the third terminal of the voltage controller. The third resistor has a first terminal coupled to the fifth terminal of the voltage controller, and a second terminal. The fourth resistor has a first terminal coupled to the first terminal of the third resistor, and a second terminal coupled to the first terminal of the first resistor.

The voltage regulation module has a first terminal coupled to the third terminal of the voltage controller, a second terminal coupled to the second terminal of the third resistor, a third terminal coupled to the second terminal of the inductor, and a fourth terminal coupled to the second input power terminal. The voltage regulation module includes a plurality of light emitting diodes coupled between the third terminal and the fourth terminal of the voltage regulation module. The voltage regulation module provides the supply voltage.

Another embodiment of the present invention discloses a light emitting diode control system. The light emitting diode control system includes an alternating current power source, a rectifier, a light emitting diode control circuit, and a shunt positive temperature coefficient (PTC) resistor.

The rectifier is coupled to the alternating current power source and transforms alternating current power received from the alternating current power source to direct current (DC) power. The light emitting diode control circuit is coupled to the rectifier through a first power input terminal and a second power input terminal, and controls a string of light emitting diodes with the direct current power received from the rectifier.

The shunt positive temperature coefficient resistor is coupled along power lines between the alternating current power source and the rectifier, and configured to present a continuously variable resistance to draw changing AC line current to lower power dissipation at high power while maintaining a triode-alternating-current (TRIAC) conduction at low power.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
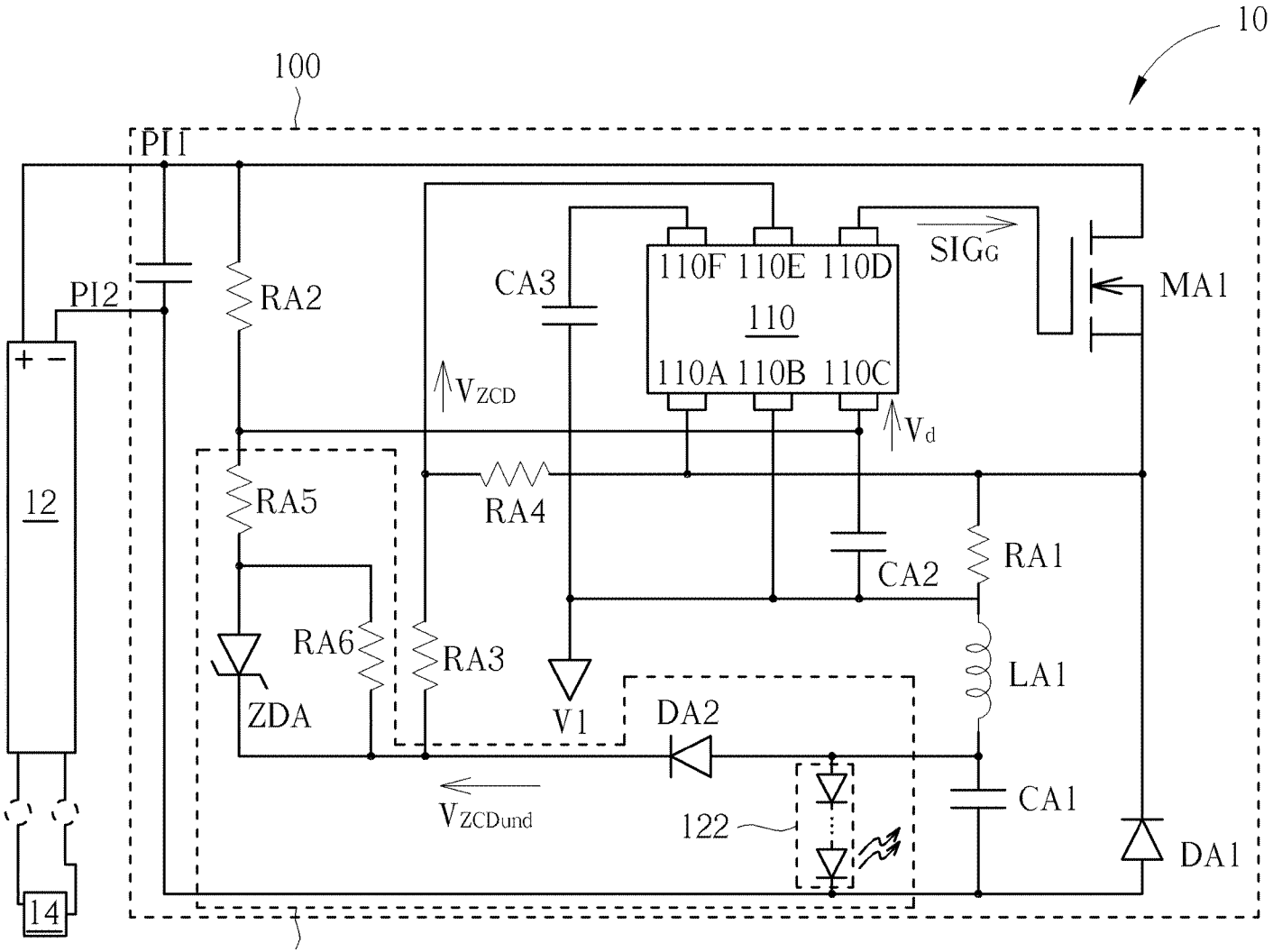
FIG. 1 shows a light emitting diode control system according to one embodiment of the present invention.

FIG. 1 shows a light emitting diode control system 10 according to one embodiment of the present invention. The light emitting diode control system 10 includes a light emitting diode control circuit 100, a rectifier 12, and an alternating current power source 14. The light emitting diode control circuit 100 includes a first power input terminal PI1, a second power input terminal PI2, a power transistor MA1, a voltage controller 110, a first resistor RA1, an inductor LA1, a second resistor RA2, a third resistor RA3, a fourth resistor RA4, and a voltage regulation module 120. In FIG. 1, the light emitting diode control circuit 100 can control a plurality of light emitting diodes 122 of the voltage regulation module 120 with a buck converter mechanism.

In some embodiments, the light emitting diode control circuit 100 can receive the line voltage input from the first power input terminal PI1 and the second power input terminal PI2. In FIG. 1, the rectifier 12 is coupled to the alternating current power source 14. For example, the rectifier 12 can receive the alternating current (AC) power from the electric socket, and the rectifier 12 can transform the AC power with a sine wave to the DC power with an absolute sine wave. In the present embodiment, the first power input terminal PI1 can receive the positive line voltage while the second power input terminal PI2 can receive the negative line voltage.

In the present embodiment, the voltage controller 110 can be a buck controller for controlling the power transistor MA1. Together, the voltage controller 110 and the power transistor MA1 can be served as a DC-to-DC power converter which steps down voltage from its input to its output, and the output voltage can be provided to the plurality of the LEDs 122. Also, to enhance the power grid quality, the voltage controller 110 may also perform active power factor correction (APFC).

In some embodiments, the voltage controller 110 includes terminals 110A to 110E. The first terminal 110A is coupled to a second terminal of the power transistor MA1, and the voltage controller 110 can sense the current outputted from the power transistor MA1 through the first terminal 110A. The second terminal 110B can receive a reference voltage V1. The reference voltage V1 can be, for example, the ground voltage of the system. The third terminal 110C can receive the supply voltage Vd of the voltage controller 110. In FIG. 1, the light emitting diode control circuit 100 may further include a second capacitor CA2 for preserving the supply voltage Vd. The second capacitor CA2 has a first terminal coupled to the third terminal 110C of the voltage controller 110, and a second terminal configured to receive the reference voltage V1. The fourth terminal 110D is coupled to a control terminal of the power transistor MA1, and can output a gate control signal $SIG_G$ to the control terminal of the power transistor MA1. The fifth terminal 110E can sense a detection voltage $V_{ZCD}$ so the voltage controller 110 can determine the timing to turn on the power transistor MA1.

In some embodiments, the voltage controller 110 may further include some other terminals for other functions according to the system requirements. For example, in FIG. 1, the voltage controller 110 may further include a sixth terminal 110F for creating a clamping protection. The sixth terminal 110F can be coupled to a third capacitor CA3 as a compensation network. However, the present invention is not limited to the voltage controller 110 shown in FIG. 1, in some other embodiments, the voltage controller 110 can be implemented by other devices that carry similar functions as mentioned in the disclosure.

The first resistor RA1 has a first terminal coupled to the second terminal of the power transistor MA1, and a second terminal for receiving the reference voltage V1. The inductor LA1 has a first terminal coupled to the second terminal of the first resistor RA1, and a second terminal. In FIG. 1, the light emitting diode control circuit 100 has a high-side switching scheme. That is, the first terminal of the power transistor MA1 is coupled to the first power input terminal PI1 for receiving the high voltage input, and the inductor LA1 can receive the high voltage input through the power transistor MA1 when the voltage controller 110 turns on the power transistor MA1.

The first diode DA1 has an anode coupled to the second power input terminal PI2, and a cathode coupled to the second terminal of the power transistor MA1. When the inductor LA1 is magnetized, the first diode DA1 is reverse-biased, and is open. However, when the inductor LA1 is demagnetized, the first diode DA1 would be turned on and can be used to provide a current path between the inductor LA1 and the LEDs 122.

The second resistor RA2 has a first terminal coupled to the first power input terminal PI1, and a second terminal coupled to the third terminal 110C of the voltage controller 110. The third resistor RA3 has a first terminal coupled to the fifth terminal 110E of the voltage controller 110, and a second terminal coupled to the second terminal of the inductor LA1 through a second diode DA2. The fourth resistor RA4 has a first terminal coupled to the first terminal of the third resistor RA3, and a second terminal coupled to the first terminal of the first resistor RA1.

The voltage regulation module 120 has a first terminal coupled to the third terminal 110C of the voltage controller 110, a second terminal coupled to the second terminal of the third resistor RA3, a third terminal coupled to the second terminal of the inductor LA1, and a fourth terminal coupled to the second input power terminal PI2. The voltage regulation module 120 can provide the supply voltage Vd for the voltage controller with the voltage received from the inductor LA1.

The voltage regulation module 120 includes a fifth resistor RA5, a sixth resistor RA6, a Zener diode ZDA, the second diode DA2, and the plurality of light emitting diodes 122.

The second diode DA2 has an anode coupled to the third terminal of the voltage regulation module 120, and a cathode coupled to the second terminal of the voltage regulation module 120. The fifth resistor RA5 is coupled in series with the second diode DA2. The sixth resistor RA6 coupled in series with the fifth resistor RA5, and the Zener diode ZDA is coupled in parallel with the sixth resistor RA6. For example, but not limited to, in FIG. 1, The fifth resistor RA5 has a first terminal coupled to the first terminal of the voltage regulation module 120, and a second terminal coupled to the sixth resistor RA6. The Zener diode ZDA has an anode coupled to the second terminal of the fifth resistor RA5, and a cathode coupled to the second terminal of the voltage regulation module 120.

The plurality of light emitting diodes 122 are coupled between the third terminal of the voltage regulation module 120 and the fourth terminal of the voltage regulation module 120. Therefore, when the power transistor MA1 is turned on and the inductor LA1 is magnetized (or charged), the light emitting diodes 122 would also receive partial input power from the inductor LA1, which enhances the conversion efficiency.

In the present embodiments, the LEDs 122 can be coupled in series as a string with the same polarity, that is, the voltage received by the anode of each of the plurality of light emitting diodes 122 would be higher than the voltage received by its cathode during magnetization and demagnetization of the inductor LA1. In some embodiments, the light emitting diode control circuit 100 may further include a first capacitor CA1 coupled in parallel with the LEDs 122, so as to sustain the voltage supplied to the LEDs 122.

With the voltage regulation module 120, the supply voltage Vd of the voltage controller 110 can be provided from the capacitor CA1 when the diode DA1 is turned on in freewheel. In this case, the supply current to the voltage controller 110 would be mainly transmitted through the sixth resistor RA6 while the Zener diode ZDA coupled in parallel with the sixth resistor RA6 is mainly used for overvoltage protection. The resistor RA5 limits the Zener diode ZDA current when it is triggered by overvoltage protection.

Although in some embodiments, the voltage controller 110 has included the function of overvoltage protection at the third terminal 110C itself, the voltage at the first capacitor CA1 may not be sensed instantly. For example, when the LEDs 122 somehow become an open load, the voltage across the first capacitor CA1 would rise, however, the overvoltage event may not be detected in time due to the big time constant of the sixth resistor RA6 and the second capacitor CA2.

Therefore, by properly selecting the Zener diode ZDA, the Zener diode ZDA would be broken down and provide a current path between the first capacitor CA1 and the third terminal 110C of the voltage controller 110, accelerating the detection of the overvoltage event and protecting the first capacitor CA1 from being damaged. However, during the normal operations, the Zener diode ZDA would remain open. That is, the designer may select the Zener diode with a breakdown voltage greater than the voltage between the second terminal of the inductor LA1 and the third terminal 110C of the voltage controller 110 during a normal operation.

The resistor RA6 can be utilized as a shunt feedback to set the supply voltage Vd as a ratio of the string voltage of the LEDs 122 because the supply current will increase with the supply voltage Vd when driving the gate capacitance of the power transistor MA1 in switching mode and vice versa.

Since the supply voltage Vd can be supplied to the third terminal 100C of the voltage controller 110 with the resistor RA6 instead of the Zener diode, the issue of opposite voltage temperature coefficients between the Zener diode and the LEDs 122 occurs in prior art can be solved, and the unexpected over voltage event and under voltage lockout can be reduced.

Also, the second diode DA2 can be used to block the initial charging current received from the first power input terminal PI1 at the beginning of the operation of the light emitting diode control circuit 100.

At the beginning of the operation of the light emitting diode control circuit 100, the supply voltage Vd of the voltage controller 110 is provided by the first power input terminal PI1 through the second resistor RA2. However, if the charging current received from the first power input terminal PI1 also goes into the voltage regulation module 120, then the charging current will have to charge the first capacitor CA1 and the second capacitor CA2 at the same time, which significantly slows down the charging process. Thus, the second diode DA2 can be added to prevent the charging current from charging the first capacitor CA1.

Furthermore, the diode DA2 also sends a rectified voltage of the inductor voltage to the fifth terminal 110E of the voltage controller 110 via a voltage divider consisting of the third resistor RA3 and the fourth resistor RA4 to eliminate the need for a negative-voltage clamping internally. The said voltage is then put in series with the sensing voltage of the inductor current to attain an analog blanking mask to prevent a premature cycle start.

Figure 2:
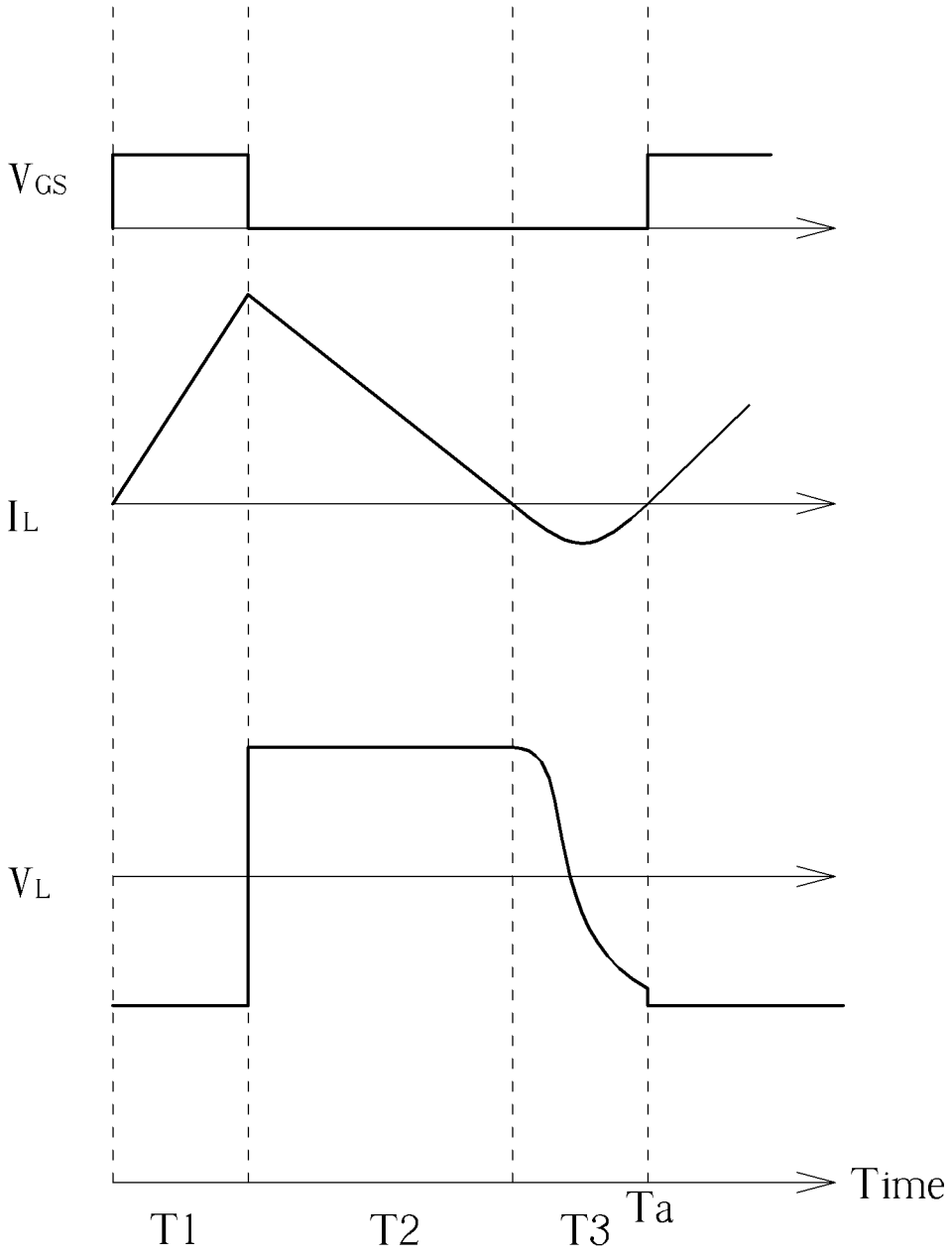
FIG. 2 shows a timing diagram of internal voltages and currents of the light emitting diode control circuit in FIG. 1.

FIG. 2 shows a timing diagram of internal voltages and currents of the light emitting diode control circuit 100. In FIG. 2, the voltage $V_{GS}$ is the gate-source voltage of the power transistor MA1, the current $I_L$ is the current conducted by the inductor LA1, the voltage $V_L$ is the voltage at the second terminal of the inductor LA1 provided to the LEDs 122.

During the time period T1, the voltage $V_{GS}$ is at a high voltage, turning on the power transistor MA1. Therefore, the inductor LA1 is magnetized (or charged), and the current $I_L$ is increased gradually. Also, the voltage $V_L$ would be lower than the reference voltage V1 since the voltage of the first terminal of the inductor LA1 is at the reference voltage V1.

During the time period T2, the voltage $V_{GS}$ is at a low voltage, turning off the power transistor MA1. Therefore, the inductor LA1 is demagnetized (or discharged), and the current $I_L$ is decreased gradually. However, to maintain the continuity of the current $I_L$, the voltage $V_L$ would turn positive and continue dumping current to the LEDs 122.

During the time period T3, the current $I_L$ of the inductor LA1 has decreased to zero, so the voltage $V_L$ begins to drop. In this case, the inductor LA1 enters a resonance state, and the current $I_L$ would bounce within a small scale. To maintain the operation of the LEDs 122, the power transistor MA1 should be turned on shortly. However, to reduce the switching loss when turning on the power transistor MA1, one suitable timing would be at the time point TA when the current $I_L$ becomes zero and is about to reverse again. That is, if the voltage controller 110 turns on the power transistor MA1 at time point TA, the driving effort would be the least since the current $I_L$ is at its minimum value.

In some embodiments, the time point TA can be detected by sensing a detection voltage, and the detection voltage can be generated by dividing the voltage $V_L$ with the third resistor RA3 and the fourth resistor RA4. In prior art, the second terminal of the fourth resistor RA4 would receive the reference voltage V1 so the detection voltage is a simple division voltage of the voltage $V_L$. The voltage controller 110 can compare the detection voltage with a predetermined reference voltage by an internal comparator, and determines to turn on the power transistor MA1 when the detection voltage crosses the predetermined voltage.

Since the voltage $V_L$ is at a negative voltage during the time period T1, the detection voltage must be clamped near zero to prevent turning on any parasitic substrate device.

Furthermore, prematurely turning on the power transistor MA1 would cause the voltage $V_L$ to fall and cross the predetermined voltage during the time period T2. To prevent the voltage controller 110 from misjudging the timing and turns on the power transistor MA1 during the time period T2, the voltage controller 110 should produce a blanking mask covering from the end of the first time period T1 to the end of the second time period T2, and the voltage controller 110 may only compare the detection voltage outside of the blanking mask.

However, in some embodiments of the present invention, the second terminal of the fourth resistor RA4 can be coupled to the first terminal of the first resistor RA1 as shown in FIG. 1. That is, the detection voltage $V_{ZCD}$ is superimposed with the sensing voltage Vs of the inductor current at the first terminal of the first resistor RA1. Since the sensing voltage Vs is always positive during the time period T1 and the time period T2, the superimposed positive voltage can be served as an accurate analog blanking mask to lock out any false detection. Therefore, the voltage controller 110 can detect the zero crossing point of the detection voltage $V_{ZCD}$ without producing any blanking mask, improving the accuracy of the detection, simplifying the design of the voltage controller 110, and reducing the hardware requirement of the voltage controller 110. The internal negative voltage clamping is also eliminated because the undivided detection voltage $V_{ZCDund}$ now swings between the LED voltage and the voltage Vd because of the diode DA2.

With the light emitting diode control circuit 100, the voltage controller 110 can receive the supply voltage Vd through the sixth resistor RA6, reducing the unexpected over voltage events and under voltage lockout events caused by the independent voltage tolerances and opposite voltage temperature coefficients between the Zener diode ZDA and the LEDs 122 in prior art. Also, by superimposing the sensing voltage Vs to the detection voltage $V_{ZCD}$, the voltage controller can compare the detection voltage $V_{ZCD}$ with the predetermined voltage without generating any blanking masks while improving the detection accuracy. The negative clamping of the inductor voltage $V_L$ is spared utilizing a shared diode within the voltage regulation module.

Figure 3:
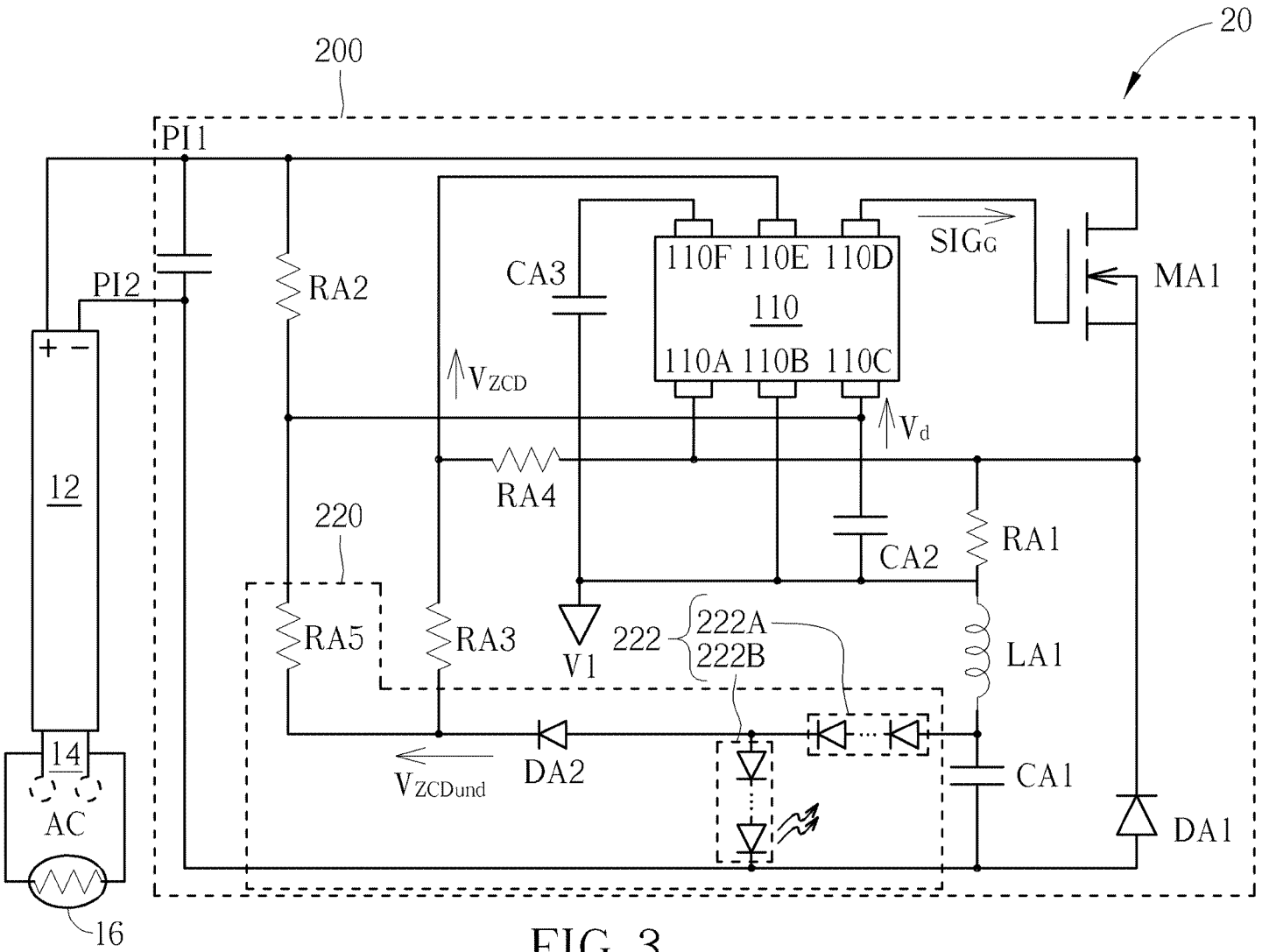
FIG. 3 shows a light emitting diode control system according to another embodiment of the present invention.

FIG. 3 shows a light emitting diode control system 20 according to another embodiment of the present invention. The light emitting diode control circuit 200 in FIG. 3 and the light emitting diode control circuit 100 have similar structures. However, the voltage regulation module 220 includes the plurality of LEDs 222 divided into two strings of LEDs 222A and 222B. The first string of LEDs 222A is coupled in series with the second string of LEDs 222B. In FIG. 3, the first string of LEDs 222A is coupled between the third terminal of the voltage regulation module 220 and the anode of the second diode DA2, while the second string of LEDs 222B is coupled between the anode of the second diode DA2 and the fourth terminal of the voltage regulation module 220.

By doing so, the second diode DA2 can charge up the capacitor CA2 very rapidly with the right voltage set by the second string of LEDs 222B. In this case, The LEDs 222B have a forward voltage matched to the operating voltage range of the voltage controller 110 as shown in FIG. 3. Also, in this case, since the supply voltage can be adjusted by the second string of LEDs 222B, the sixth resistor RA6 and the Zener diode ZDA can be removed, so the fifth resistor RA5 would be coupled between the first terminal of the voltage regulation module 220 and the second terminal of the voltage regulation module 220.

Figure 4:
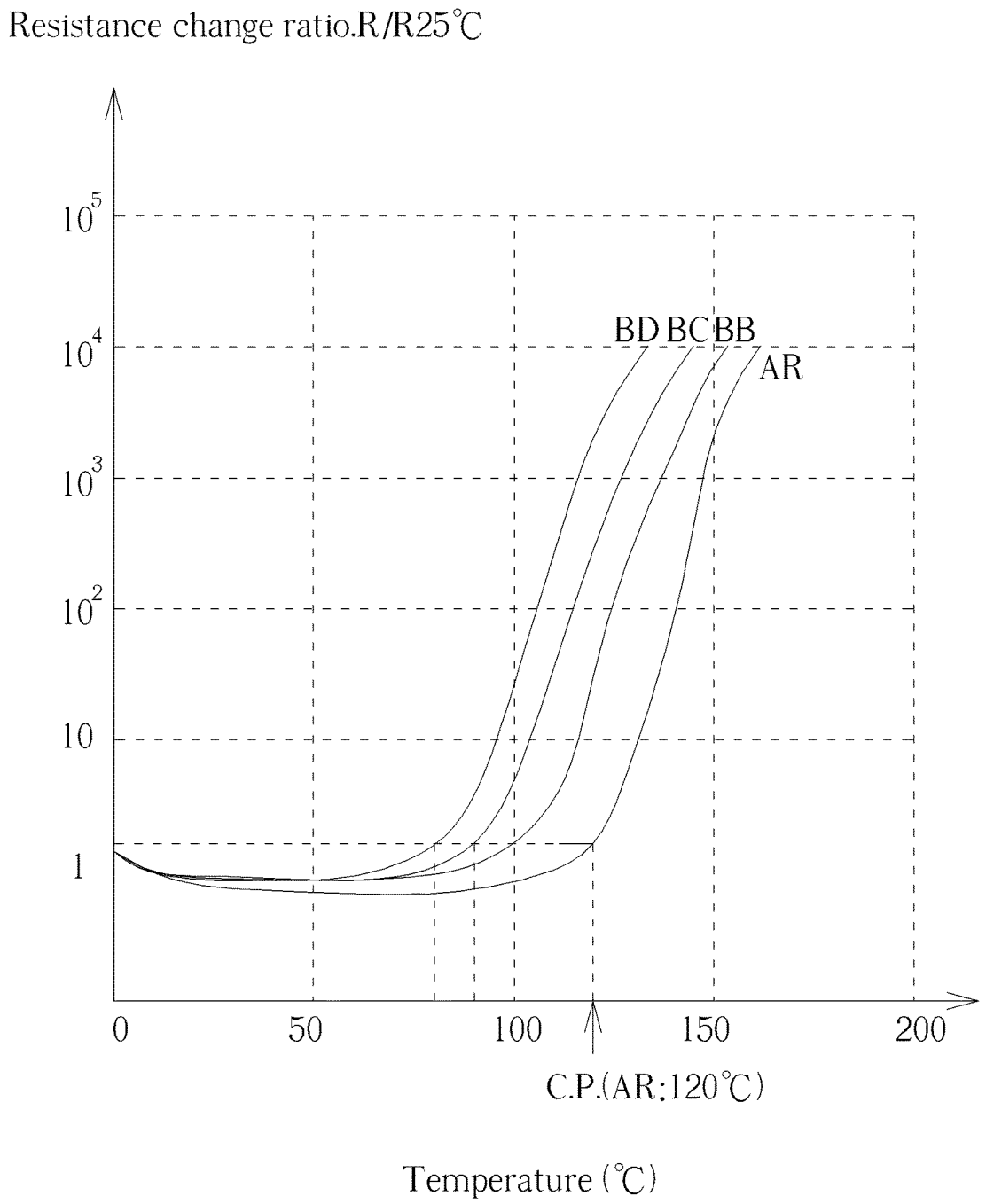
FIG. 4 shows the characteristic curves of a positive temperature coefficient resistor.

In addition, in the light emitting diode control system 20, a shunt positive temperature coefficient (PTC) resistor 16 is connected across the AC power lines. FIG. 4 shows the characteristic curves of a PTC resistor. Due to sharp resistance rise at Curie point (C.P.), the device operates in constant temperature or constant power per se. In other words, the device current is inversely proportional to the device voltage, i.e., a continuously variable resistor. The continuously variable resistance presented by the shunt PTC resistor 16 can draw changing AC line current to lower the power dissipation at high power for better efficiency, while it draws more current at low power to sustain the triode-alternating-current (TRIAC) conduction as a bleeder effectively. Therefore, the light emitting diode control system 20 is also suitable for the TRIAC dimming applications.

However, in some other embodiments, the shunt PTC resistor may be disposed in other positions along the power lines between the AC power source 14 and the diode bridge of the rectifier 12.

Once the shunt PTC resistor is implemented on the AC line path, many more resistive types of light emitting diode control circuits such as buck converters with active power factor correction can be dimmed by a TRIAC because the PTC resistor is resistive and draws increasingly more current at low power.

Figure 5:
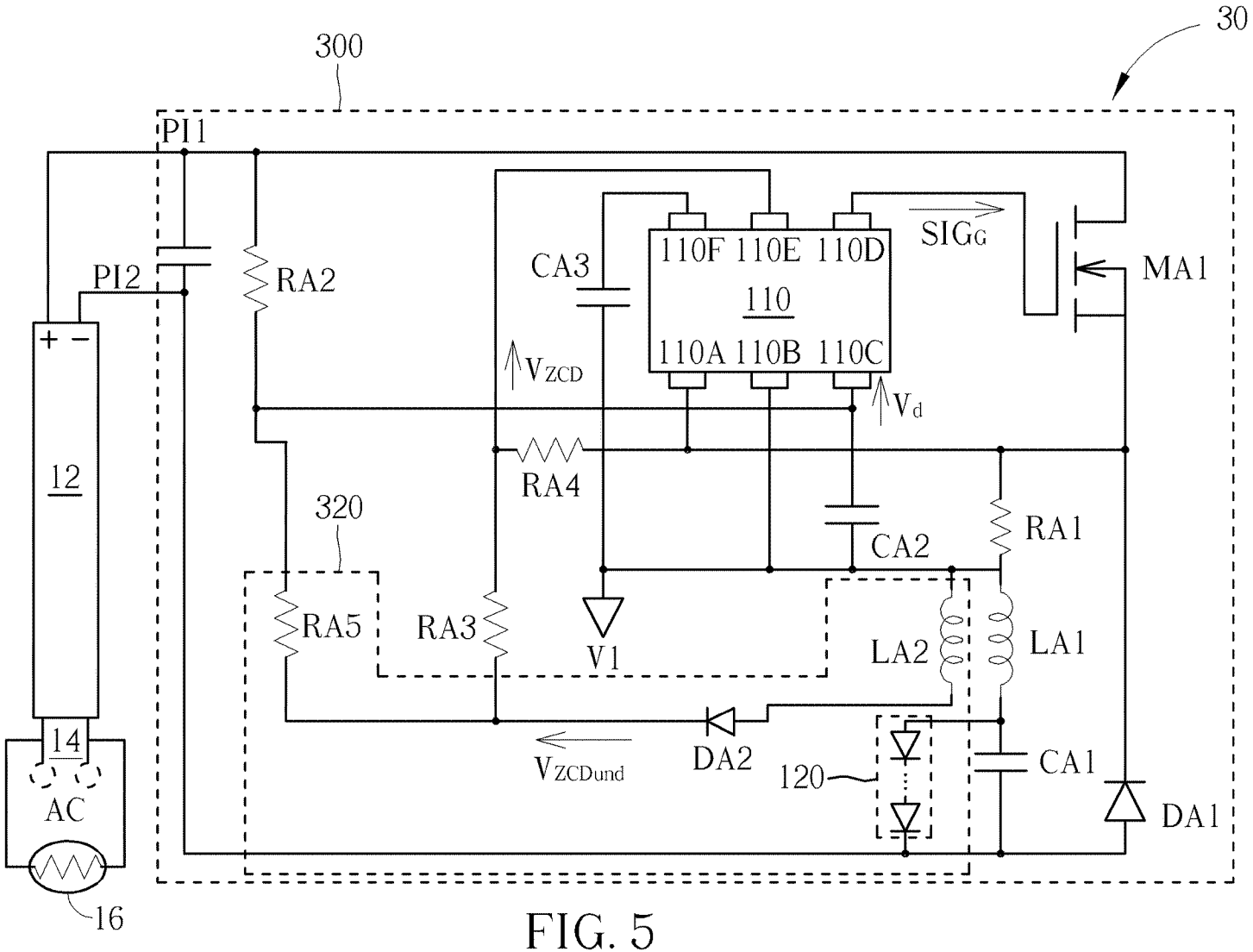
FIG. 5 shows a light emitting diode control system according to another embodiment of the present invention.

FIG. 5 shows a light emitting diode control system 30 according to another embodiment of the present invention. The light emitting diode control circuit 300 shown in FIG. 5 and the light emitting diode control circuit 100 have similar structures. However, the voltage regulation module 320 further includes an auxiliary winding LA2 magnetically coupled to the inductor LA1 to provide a rapid charge to the capacitor CA2. The auxiliary winding LA2 has a first terminal coupled to the second terminal of the second capacitor CA2, and a second terminal coupled to the anode of the second diode DA2.

In this case, the sixth resistor RA6 and the Zener diode ZDA can be removed, so the fifth resistor RA5 would be coupled between the first terminal of the voltage regulation module 320 and the second terminal of the voltage regulation module 320.

Also, in FIG. 5, since the shunt PTC resistor 16 operates in constant temperature because of the sharp rise of resistance at Curie point, it becomes a constant power device of which current is inversely proportional to voltage. Therefore it can minimize the power consumption at full power for better efficiency, while it draws more current at low power to sustain the TRIAC conduction as a bleeder effectively. Consequently, the light emitting diode control system 30 is also suitable for the TRIAC dimming applications. The PTC resistor may be disposed in other positions along the path between the AC power lines and the diode bridge of the rectifier 12.

In summary, the light emitting diode control circuits and systems provided by the embodiments of the present invention can provide the supply voltage to the voltage controller through a resistor according to the string voltage of the light emitting diodes. Therefore, the unexpected over voltage event and under voltage lockout caused by the opposite voltage temperature coefficients between the Zener diode and the LEDs in prior art can be solved. Furthermore, the light emitting diode control circuits can receive the supply voltage efficiently and stably with less hardware components than in prior art. Also, by superimposing the internal positive voltage to the detection voltage, the light emitting diode control circuit can detect the timing to turn on the power transistor even more accurately without generating any blanking masks, and the negative clamping of the inductor voltage can be spared utilizing a shared diode within the voltage regulation module, simplifying the design of the light emitting diode control circuits. And a fast-charging method along with a voltage-dependent shunt PTC resistor enables a buck converter with active power factor correction among many others to function as a TRIAC dimmable controller.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitting diode control circuit comprising:

a first power input terminal;

a second power input terminal;

a power transistor having a first terminal coupled to the first power input terminal, a second terminal, and a control terminal;

a voltage controller comprising:

a first terminal coupled to the second terminal of the power transistor and configured to sense a current outputted from the power transistor;

a second terminal configured to receive a reference voltage;

a third terminal configured to receive a supply voltage;

a fourth terminal coupled to the control terminal of the power transistor and configured to output a gate control signal to the control terminal of the power transistor; and a fifth terminal configured to sense a detection voltage;

a first resistor having a first terminal coupled to the second terminal of the power transistor, and a second terminal configured to receive the reference voltage;

an inductor having a first terminal coupled to the second terminal of the first resistor, and a second terminal;

a first diode having an anode coupled to the second power input terminal, and a cathode coupled to the second terminal of the power transistor;

a second resistor having a first terminal coupled to the first power input terminal, and a second terminal coupled to the third terminal of the voltage controller;

a third resistor having a first terminal coupled to the fifth terminal of the voltage controller, and a second terminal;

a fourth resistor having a first terminal coupled to the first terminal of the third resistor, and a second terminal coupled to the first terminal of the first resistor; and a voltage regulation module having a first terminal coupled to the third terminal of the voltage controller, a second terminal coupled to the second terminal of the third resistor, a third terminal coupled to the second terminal of the inductor, and a fourth terminal coupled to the second input power terminal, the voltage regulation module comprising a plurality of light emitting diodes coupled between the third terminal and the fourth terminal of the voltage regulation module, and the voltage regulation module being configured to provide the supply.

2. The light emitting diode control circuit of claim 1, further comprising a first capacitor coupled in parallel with the plurality of light emitting diodes.

3. The light emitting diode control circuit of claim 1, wherein:

the voltage regulation module further comprises:

a second diode having an anode coupled to the third terminal of the voltage regulation module, and a cathode coupled to the second terminal of the voltage regulation module.

4. The light emitting diode control circuit of claim 3, wherein the second diode rectifies an inductor voltage for zero crossing detection.

5. The light emitting diode control circuit of claim 3, wherein the voltage regulation module further comprises a fifth resistor coupled in series with the second diode.

6. The light emitting diode control circuit of claim 5, wherein the voltage regulation module further comprises a sixth resistor coupled in series with the fifth resistor.

7. The light emitting diode control circuit of claim 6, wherein the voltage regulation module further comprises a Zener diode coupled in parallel with the sixth resistor.

8. The light emitting diode control circuit of claim 7, wherein a breakdown voltage of the Zener diode is greater than a voltage between the second terminal of the inductor and the third terminal of the voltage controller during a normal operation.

9. The light emitting diode control circuit of claim 1, wherein the voltage controller detects a zero crossing point through a rectified inductor voltage stacked with the detection voltage of the inductor current.

10. The light emitting diode control circuit of claim 1, wherein the voltage regulation module further comprises a second diode having a cathode coupled to the second terminal of the voltage regulation module.

11. The light emitting diode control circuit of claim 10, wherein:

the plurality of light emitting diodes comprises:

a first string of light emitting diodes coupled between the third terminal of the voltage regulation module and an anode of the second diode; and a second string of light emitting diodes coupled between the anode of the second diode and the fourth terminal of the voltage regulation module.

12. The light emitting diode control circuit of claim 11, wherein the voltage regulation module further comprises a fifth resistor coupled between the first terminal of the voltage regulation module and the second terminal of the voltage regulation module.

13. The light emitting diode control circuit of claim 11, wherein the second string of light emitting diodes has a forward voltage matched to an operating voltage range of the voltage controller for a rapid charge.

14. The light emitting diode control circuit of claim 11, further comprising a shunt positive temperature coefficient (PTC) resistor coupled between alternating current power lines, wherein the alternating current power lines are coupled to the first power input terminal and the second power input terminal.

15. The light emitting diode control circuit of claim 14, wherein the shunt positive temperature coefficient resistor is configured to draw an alternating current line current for lower powering dissipation at high power while maintaining a triode-alternating-current (TRIAC) conduction at low power.

16. The light emitting diode control circuit of claim 10, further comprising a second capacitor having a first terminal coupled to the third terminal of the voltage controller, and a second terminal configured to receive the reference voltage.

17. The light emitting diode control circuit of claim 16, wherein the voltage regulation module further comprises an auxiliary winding magnetically coupled to the inductor, and configured to provide a rapid charge to the second capacitor.

18. The light emitting diode control circuit of claim 17, wherein the auxiliary winding has a first terminal coupled to the second terminal of the second capacitor, and a second terminal coupled to the anode of the second diode.

19. The light emitting diode control circuit of claim 16, wherein the voltage regulation module further comprises a fifth resistor coupled between the first terminal of the voltage regulation module and the second terminal of the voltage regulation module.

20. The light emitting diode control circuit of claim 16, further comprising a shunt positive temperature coefficient (PTC) resistor coupled between alternative current power lines coupled to the first power input terminal and the second power input terminal.

21. The light emitting diode control circuit of claim 20, wherein the shunt positive temperature coefficient resistor is configured to draw changing AC line current to lower power dissipation at high power while maintaining a triode-alternating-current (TRIAC) conduction at low power.

* * * * *